US005398848A

United States Patent [19]

Padamsee

[11] Patent Number: 5,398,848

[45] Date of Patent: Mar. 21, 1995

[54] PORTABLE LIQUID CONTAINER

[76] Inventor: Alimohamed C. Padamsee, Sheriss Devki St. P.O. Box 3131, Bombay, India

[21] Appl. No.: 15,353

[22] Filed: Feb. 8, 1993

[51] Int. Cl.[6] ..... B65D 35/22

[52] U.S. Cl. ..... 222/94; 222/105; 222/131; 222/146.6; 222/175

[58] Field of Search ..... 222/92, 94, 105, 131, 222/175, 206, 209, 146.6, 568

[56] References Cited

U.S. PATENT DOCUMENTS

| | | | |
|---|---|---|---|
| 2,732,977 | 1/1956 | Charpiat | 222/131 |
| 2,780,378 | 2/1957 | Romano | 222/209 X |
| 2,915,222 | 12/1959 | Purinton | 222/175 |
| 3,083,877 | 4/1963 | Gash | 222/105 X |
| 3,156,383 | 11/1964 | Melli | 222/209 X |
| 4,197,890 | 4/1980 | Simko | 150/2.2 |
| 4,886,194 | 12/1989 | Schiemann | 222/568 X |
| 5,242,422 | 7/1993 | Schneberger et al. | 222/206 X |
| 5,248,071 | 9/1993 | Ray | 222/568 |

*Primary Examiner*—Andres Kashnikow
*Assistant Examiner*—Joseph A. Kaufman
*Attorney, Agent, or Firm*—Bierman & Muserlian

[57] ABSTRACT

A portable liquid container comprising a non-rigid pouch of textile material, having thermally insulated flexible walls, which can receive and hold a compressible liquid therein; a compressible liquid containment portion having a pair of opposing rigid walls connected to each other by a second pair of resilient, collapsible bellows-type side walls, and a rigid mouth-bearing neck element secured to one of the pair of side walls, the neck element provided with a threaded portion; and sealed lobes filled with air, the liquid containment portion being adapted to be placed in a freezer compartment for freezing the liquid contents of the liquid containment portion, the sealed lobes being adapted to compress and take up the pressure of expansion of the frozen contents of the liquid containment portion; a two piece stopper having a main body which can be screwed on to the threaded portion of the neck element, the main body bearing an apertured threaded nozzle formation, through which liquid can be ejected in the form of a jet by displacing the rigid walls of the liquid containment portion towards each other, and a nozzle cover which can be screwed on to the threaded nozzle formation.

5 Claims, 5 Drawing Sheets

PORTABLE LIQUID CONTAINER

BACKGROUND OF THE INVENTION

1. Field of the Invention

The present invention relates to a liquid container. Particularly, the invention relates to a portable liquid container. More particularly, the invention relates to a thermally insulated portable liquid container.

2. Brief Description of the Prior Art

Portable liquid containers in the form of rigid water bottles and canteens are known in the prior art. Further, portable liquid containers in the form of vacuum flasks are also known. Conventional water bottles and canteens do not retain therein at desired temperatures. On the other hand, vacuum flasks provide adequate thermal insulation for retaining hot and cold liquids at desired temperatures, but vacuum flasks are bulky and fragile.

OSBORNE, U.S. Pat. No. 2,013,358 discloses a knapsack water bottle comprising a foldable and collapsible rubber water bag disposed in a knapsack and conforming to the internal contour of the knapsack. A discharge fitting is connected at the bottom of the bag and projects through an opening in the knapsack. Liquids can only be dispensed from the water bag by gravity flow.

DEVLIN, U.S. Pat. No. 3,840,153 provides a drinking utensil having flexible walls and a conduit extending into the container. The construction the utensil permits the insertion of a refrigerated capsule to be inserted around the container. However, the container as a whole cannot be refrigerated and, moreover, it is very difficult to clean the insides of the container.

SIMKO, U.S. Pat. No. 4,197,890 provides an insulation jacket for beverage bottles which includes a cylindrical wrapper of insulating material shaped to fit a rigid bottle. Liquid can again be dispensed from the bottle by gravity.

MOTSENBOCKER, U.S. Pat. No. 4,420,097 discloses a portable liquid dispenser with a carrying case. The container is pillow-shaped. The carrying case is of a similarly shaped fabric material. Liquid can be dispensed from the bag by means of a discharge tube having valve and nozzle arrangement at its aboral end. Liquid can only be discharged through this dispenser by gravity flow.

HOBSON, U.S. Pat. No. 4,871,597 provides a light weight multi-layered insulating enclosure for enclosing containers holding liquids. Again, liquids can only be dispensed from a container retained in the enclosure by gravity.

The prior art, in general, and these patents in particular, do not provide for simple means for charging, discharging and cleaning the liquid container. Furthermore, the portable liquid containers of the prior art do not provide for controlling the temperature of the liquid contained therein within desired limits.

Further, portable liquid containers that are squeezable so as to eject the contents such as flexible bottles and wine skin bladders, are known in the prior art. However, prior art squeezable portable liquid containers cannot retain the temperature of their contents.

OBJECTS OF THE INVENTION

In view of the foregoing, it is the aim of the invention to achieve the following objects, either alone or in combination:

- to provide a lightweight, inexpensive, aesthetic, portable liquid container suitable for a variety of applications;
- to provide a portable liquid container from which liquid can be charged and discharged with ease and convenience;
- to provide a portable liquid container in which the liquid contained can be stored at temperatures within pre-determined limits;
- to provide a portable liquid container which can be cleaned of residual liquid after discharge;
- to provide a portable liquid container which can be directly placed in a refrigerator for cooling;
- to provide a portable liquid container suitable for mass production and which can be made of cheaply available plastic materials;
- to provide a portable liquid container which is thermally insulated, yet is flexible enough to allow squeezing so as to eject its contents through a nozzle in the form of a jet, directly into the user's mouth, allowing hygienic use by several users, and allowing non-contact drinking against gravity; and
- to provide a portable liquid container which can be strapped to the body of a person.

SUMMARY OF THE INVENTION

According to the invention, there is provided a portable liquid container which comprises:

- a non-rigid pouch of textile material, having thermally insulated flexible walls, which can receive and hold a compressible liquid containment means therein;
- a compressible liquid containment means having a pair of opposing rigid walls connected to each other by a second pair of resilient, collapsible bellows-type side walls, and a rigid mouth-bearing neck element secured to one of the pair of side walls, said neck element provided with a threaded portion; and
- a two-piece stopper having
  - a main body which can be screwed on to the threaded portion of the neck element, said main body bearing an apertured threaded nozzle formation, through which liquid can be ejected in the form of a jet by displacing the rigid walls of the liquid containment means towards each other; and
  - a nozzle cover which can be screwed on to the threaded nozzle formation.

The liquid containment means may be of non-toxic synthetic polymeric material. Particularly, the liquid containment means may be formed by welding the pair of resilient walls to the pair of rigid walls at their respective edges.

The pouch may be of any suitable material, typically, a fluid impervious material. Typically, the pouch has an outside jacket of nylon fabric packed with a polyvinyl chloride sheet on the inside to make the jacket waterproof.

The walls of the pouch may be thermally insulated by means of multi-layered flexible insulation comprising at least one sheet of aluminum foil.

The pouch may be provided with an opening remote from the neck region. The said opening may be securable by means of a zipper and runner formation. The opening may provide access to the liquid containment means within the pouch. Further, sachets containing refreezable solutions of a liquid or gel mixture of distilled water and propylene glycol that lowers the freezing temperature and increases heat transfer may be insertable through the opening to maintain the temperature of liquid contained in the liquid containment means at a desired low temperature. Typically, two sachets containing freezing solutions may be provided to enable the sachets to sandwich the liquid containment means within the pouch. The degree of cooling can be regulated by increasing or decreasing the number of sachets.

The rigid walls as well as the bellows-type flexible side walls of the liquid containment means may be of a synthetic polymeric material such as LDPE/EVA. Particularly, the liquid containment means may be of the type that can be cleaned through a dishwasher.

The neck element of the liquid containment means may be moulded of a synthetic polymeric material and may be secured rigidly to one of the pair of bellows-type side walls of the liquid containment means. The neck element may include a threaded portion extending out of the outer pouch.

A two-piece stopper may be provided having threads complementary to the threads on the neck element to enable the stopper to be fitted onto the projecting threaded portion of the neck element. The stopper may be provided with an apertured nozzle formation with external threads and a nozzle cover with threads complementary to the external threads on the nozzle formation may further be provided, the nozzle formation permitting discharge of a liquid jet from the liquid containment means through the neck element, said discharge being achieved by compressing the rigid walls of the liquid containment means to enable liquid stored in the liquid containment means to stream out through the apertured nozzle formation in the form of a jet. The jet of liquid reduces the need to tip the head back into an abnormal position for drinking, while at the same time, avoiding contact between the users mouth and the exit point of the liquid from the liquid containment means. The jet may also be directed for washing of wounds, utensils and the body, the force of the stream being sufficient to clear out dirt with minimum wastage of liquid contents.

The nozzle cover may be replaceably secured to the stopper by means of a link and chain attachment of corrosion resistant material such as stainless steel. The pouch may be provided with a carrying strap to allow the liquid container to be carried in the hand or across the shoulder.

An O-ring may be provided around an apertured region at one end of the pouch through which the neck element projects therethrough for securely holding the neck element and the pouch together. Preferably, the O-ring may be integral with the pouch at the apertured region, thereby permitting the sealing of any leakage when the stopper assembly is screwed on.

BRIEF DESCRIPTION OF THE DRAWINGS

The invention will now be described with reference to the accompanying drawings, in which.

DESCRIPTION OF THE PREFERRED EMBODIMENT

Figure 1:
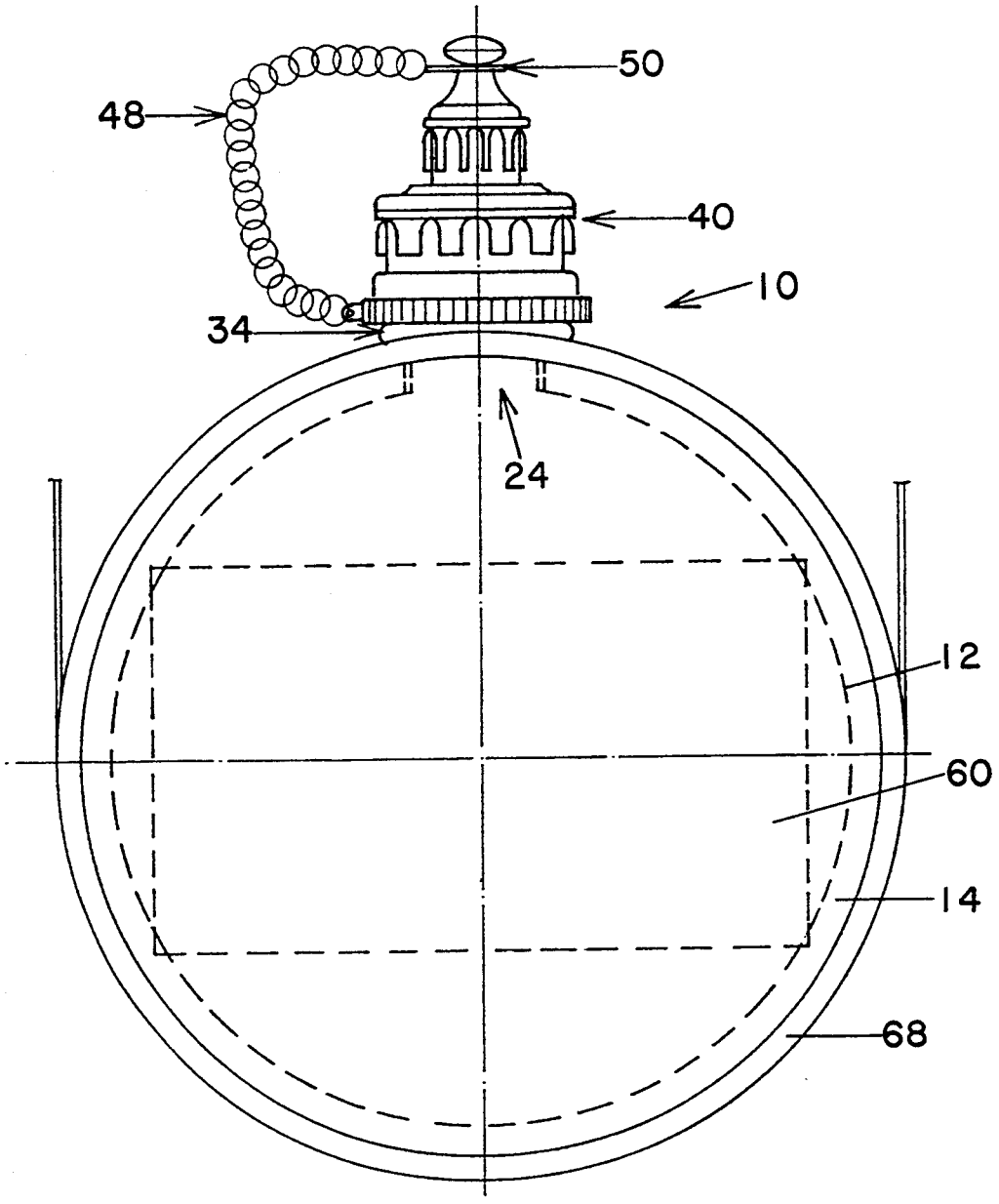
FIG. 1 is a front view of a portable liquid container in accordance with the invention.

In the drawings, a portable liquid container in accordance with invention, is indicated generally by the reference numeral 10. The portable liquid container 10 comprises a liquid containment means in the form of a collapsible bladder 12 and a pouch 14 that can receive and hold the bladder 12 therein. The bladder 12 is of LDPE/EVA synthetic polymeric material.

The bladder 12 comprises a pair of rigid walls 16 and 18 and a pair of bellows-type collapsible walls 20 and 22. The bladder is formed by welding or otherwise joining the edges of the pair of walls 20 and 22 to the edges of the pair of walls 16 and 18.

The collapsible wall 20 has an opening 24 in which is secured a neck element 26. The neck element 26 defines a threaded portion 28, having a mouth 29. The threaded portion 28 bearing the mouth 29 is adapted to project through a first opening 30 at one end of the pouch 14. The neck element 26 further defines a flange formation 32 which restricts the complete projection of the neck element through she opening 30 of the pouch 14. An O-ring 34, typically of silicone, is integrally formed or secured around the opening 30 to provide rigidity to the opening 30, and a waterproof sealing engagement between the neck element 26 and the pouch 14.

A two-piece stopper 40 of a non-toxic moldable synthetic polymeric material, such as polypropylene, is provided, having a main body 41 provided with complementary threads which can be screwed on to the threaded portion 28 of the neck element and which can thereby securely cover the mouth 29 of the threaded portion 28 of the neck element 26. The roof portion of the main body 41 defines an apertured nozzle formation 42 having external threads. The stopper 40 further includes a nozzle cover 44 having threads complementary to the external threads on the nozzle formation 42 to enable the nozzle cover 44 to be screwed on to the apertured nozzle formation 42. A stainless steel link 46 is secured to the nozzle cover 44 which is connected to the main body 41 by means of a stainless steel chain 48 and a ring 50.

Figure 2:
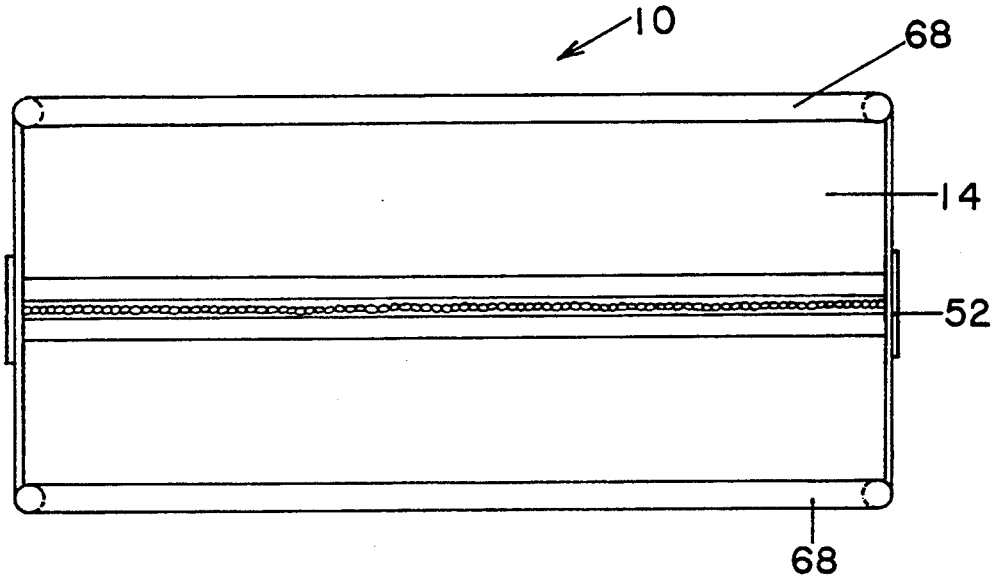
FIG. 2 is a bottom view of the container of FIG. 1.

The pouch 14 is provided with a zippered second opening 52 as can be seen in FIG. 2. The liquid containment means 12 bearing the neck element 26 can be inserted into the pouch 14 through the second opening 52 so that the threaded portion 28 of the neck element 26 of the liquid containment means 12 projects through the first opening 30 of the pouch 14. The flange formation 32 prevents the complete displacement of the neck element 26 through the first opening 30. Once the threaded portion 28 stands proud of the pouch 14, the stopper 40 can be screwed on to the threaded portion 28 to secure the liquid containment means 12 rigidly to the pouch 14.

A freezable pack 60 can be inserted between the wall of the pouch 14 and the rigid wall 16 of the liquid containment means 12 to regulate the temperature of the contents of the liquid containment means. The freezable pack 60 is also insertable through the the zippered second opening 52 of the pouch 14, provided with a zipper nylon chain.

Liquid to be dispensed can be charged into the liquid containment means 12 through the mouth 29 in the neck element 26. The charging of the liquid in the liquid containment means 12 can be done when the liquid containment means is received within the pouch 14, with the neck element 26 projecting through the opening 30. The O-ring 34 which defines the opening 30 frictionally holds the neck element 26 in place. Liquid to be charged into the liquid containment means 12 is poured through the opening 30 in the neck element 26 before the stopper 40 is screwed on to the threaded portion 28. Once the liquid is charged in the liquid containment means, the stopper 40, which includes the main body 41 and the nozzle cover 44, is screwed on and tightened. The liquid containment means 12 is now sealingly engaged to the pouch 14 by the flange 32 abutting the lower surface of the pouch 14 below the O-ring 34. Sealing engagement is achieved by the pressure exerted on the O-ring 34 and the flange 32 by the flared portion 62 of the stopper 40.

Figure 3:
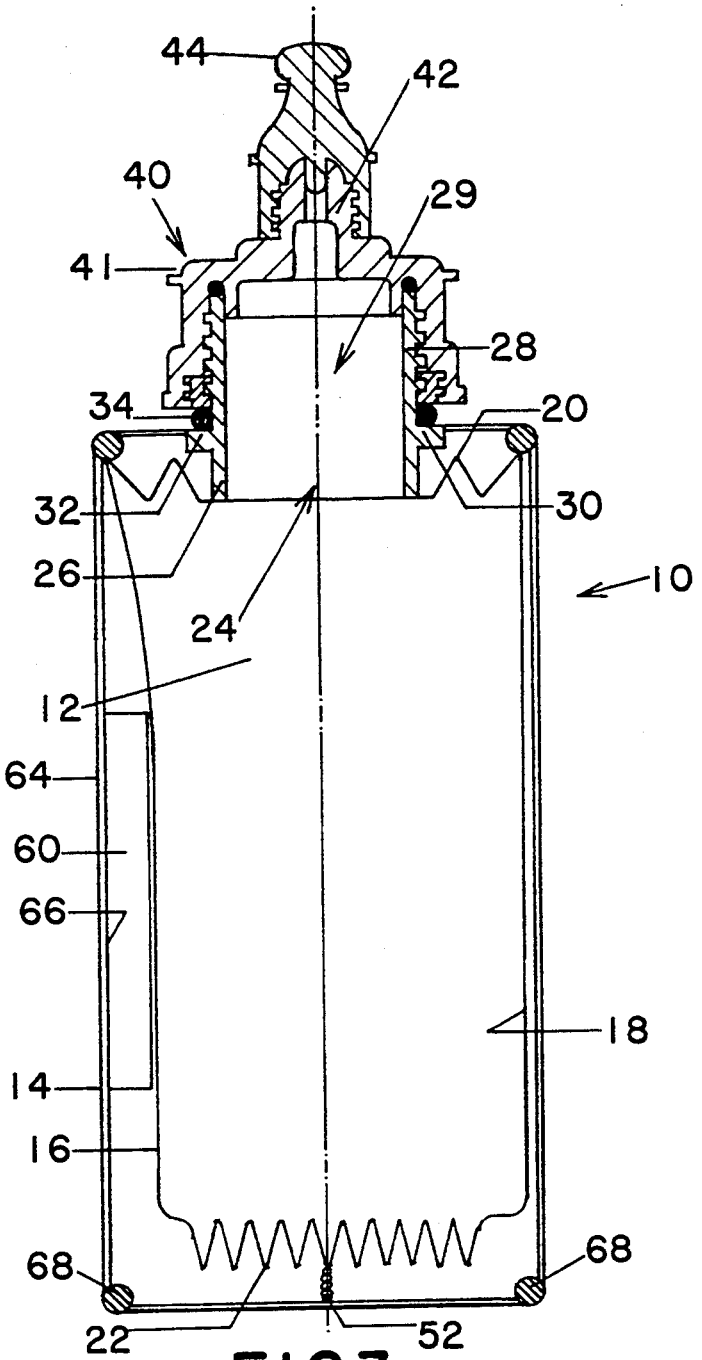
FIG. 3 is a side-sectional view of the container of FIG. 1.

The freezable pack 60 is preferably inserted between the wall of the pouch 14 and the rigid wall 16 of the liquid containment means 12 before charging the liquid containment means 12 with its liquid contents. Once the liquid containment means 12 is charged, the pack 60 is resiliently held in place, sandwiched between the wall of the pouch 14 and the liquid containment means 12 as seen in FIG. 3.

Discharge of liquid from the liquid containment means 12 will be usually done through the aperture in the nozzle formation 42 by removing the nozzle cover 44. It can be easily understood that during the discharge of liquid in the form of a jet through the nozzle formation 12 , the main body 41 remains in place and the liquid containment means 12 is firmly secured to the pouch 14 . It can also be understood that if gravity discharge of liquid from the liquid containment means 12 is desired, the stopper 40 can be completely unscrewed from the threaded portion 28 to expose the mouth 29 and the liquid from the liquid containment means can be poured out.

The construction of the liquid containment means 12 is particularly suitable for washing and cleaning the liquid containment means 12 of its residual contents after discharge. The liquid containment means 12 , in accordance with this invention, can be washed and cleaned through a dishwasher.

The pouch 14 has a multi-layered wall, the outer casing 64 being of flexible nylon and the inner casing 66 being aluminum foil. The pouch 14 is provided with beading 68 around it periphery to provide structural rigidity of the pouch 14 , and at the same time, maintaining its flexibility. The beading 68 is typically of a synthetic polymeric material such as polyvinyl chloride In use, any desired liquid can be charged in the liquid containment means 12 . The freezable pack 60 containing low-temperature freezing solution, including propylene glycol, can be inserted into the pouch. The pack 60 assists in maintaining liquid stored in the liquid containment means 12 at a desirable low temperature. The aluminum foil inner casing 66 reflects radiant heat away from the liquid containment means 12 , further assisting in the maintenance of the desirable low temperature.

Figure 4:
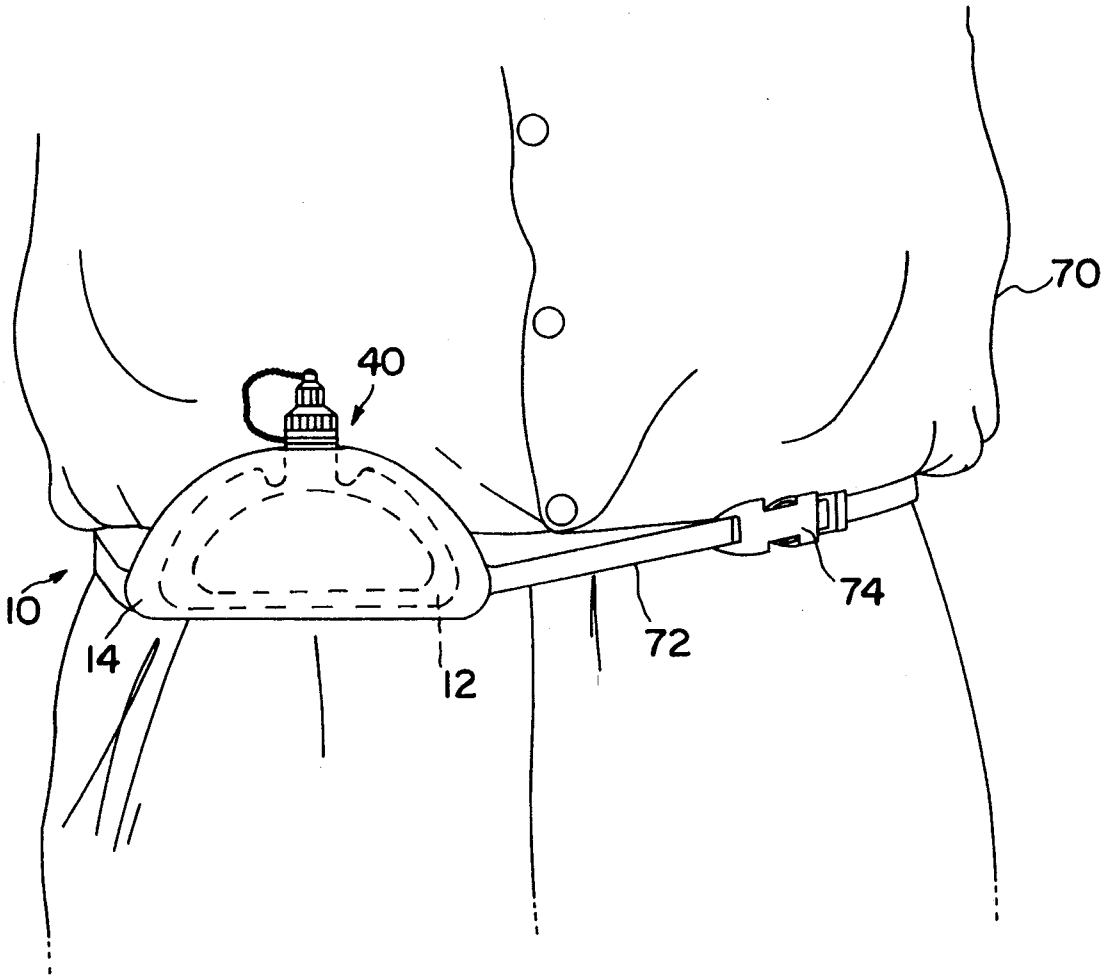
FIG. 4 is an alternative embodiment of the portable liquid container of FIG. 1.
Figure 5:
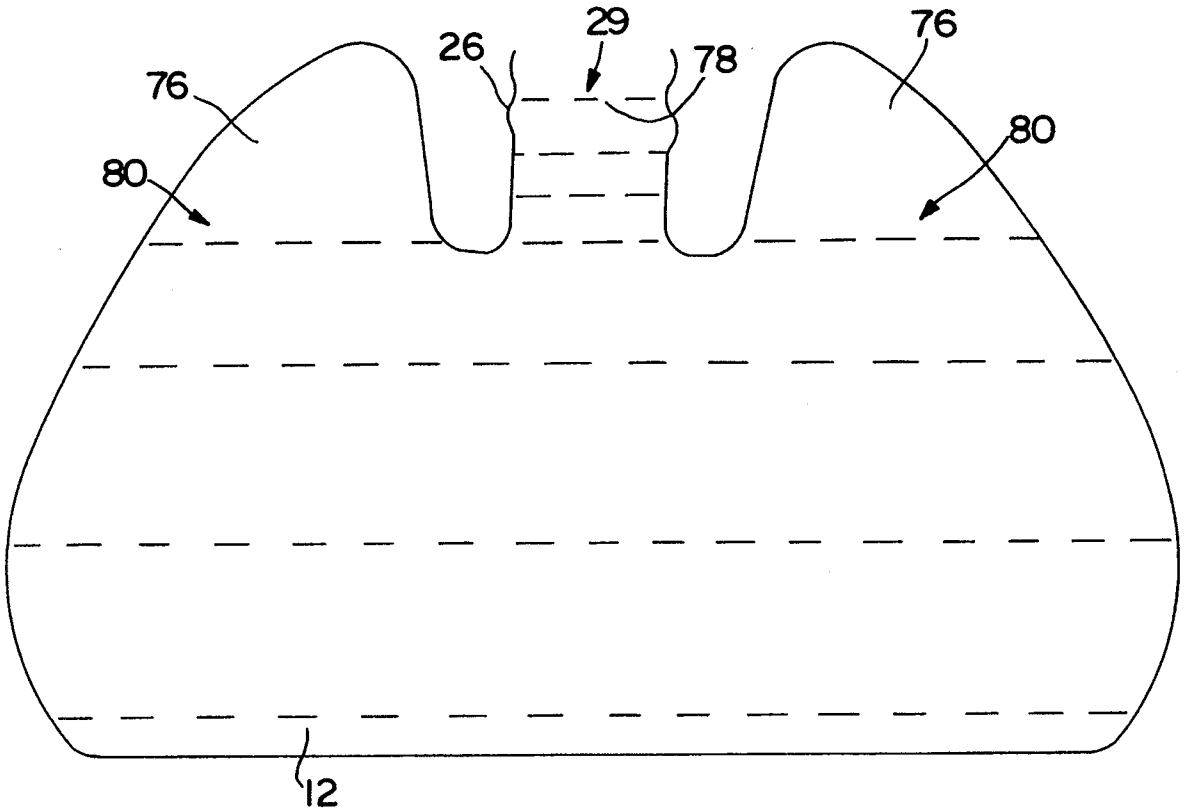
FIG. 5 is a liquid containment means for the embodiment of the portable liquid container of FIG. 4.

FIG. 4 illustrates an embodiment of the portable liquid container, in accordance with this invention, in a semicircular shape. This embodiment of the invention is particularly suitable for strapping the container to the body 70 of a user by means of a strap 72 and buckle 74. When strapped to the body 70, the portable container 10 contours the body portion so strapped. In this embodiment, the entire container 10 or the liquid containment means 12 , adequately stoppered with the stopper 40, may be placed in the freezer compartment of a refrigerator in order to freeze the contents in the liquid containment means. The liquid containment means 12 for the purpose of this embodiment illustrated in FIG. 4 is of a special shape as illustrated in FIG. 5. The liquid containment means 12 is provided with sealed lobes 76 filled with air, as particularly seen in FIG. 5. When liquid is poured into the liquid containment means 12 , through the mouth 29, the liquid rises to a level 78 in the neck element 26 , but only rises to a level 80 in the lobes 76 because air trapped in the air pockets of the upper lobes 76 has no means of egress. Liquid normally expands when frozen and, when the liquid in the liquid containment means 12 freezes, the expansion of the liquid causes the air pockets in the upper lobes 76 to compress and take up the pressure of expansion, thereby preventing the liquid containment means 12 from bursting during freezing.

I claim:

1. A portable liquid container comprising a non-rigid pouch of textile material, having thermally insulated flexible walls, which can receive and hold a compressible liquid means therein;

a compressible liquid containment means having a pair of opposing rigid walls connected to each other by a second pair of resilient, collapsible bellows-type side walls, and a rigid mouth-bearing neck element secured to one of the pair of side walls, said neck element provided with a threaded portion; and sealed lobes filled with air, said liquid containment means being adapted to be placed in a freezer compartment for freezing the liquid contents of the liquid containment means, said sealed lobes being adapted to compress and take up the pressure of expansion of the frozen contents of the liquid containment means a two piece stopper having a main body which can be screwed on to the threaded portion of the neck element, said main body bearing an apertured threaded nozzle formation, through which liquid can be ejected in the form of a jet by displacing the rigid walls of the liquid containment means towards each other, and a nozzle cover which can be screwed on to the threaded nozzle formation.

2. A portable liquid container, according to claim 1, in which the walls of the pouch include at least one sheet of aluminum foil.

3. A portable liquid container, according to claim 1, in which the pouch is provided with a zippered opening through which the liquid containment means can be inserted into the pouch, and a second opening through which the neck element of the liquid containment means can protrude through the pouch.

4. A portable liquid container, according to claim 1, which includes a strap for strapping the container to the body of a user.

5. A portable liquid container comprising a non-rigid pouch of textile material, having thermally insulated flexible walls, which can receive and hold a compressible liquid containment means therein;

a compressible liquid containment means having a pair of opposing rigid walls connected to each other by a second pair of resilient, collapsible bellows-type side walls, and a rigid mouth-bearing neck element secured to one of the pair of side walls, said neck element provided with a threaded portion, said liquid containment means further includes sealed lobes filled with air, said liquid containment means being adapted to be placed in a freezer compartment for freezing the liquid contents of the liquid containment means, said sealed lobes being adapted to compress and take up the pressure of expansion of the frozen contents of the liquid containment means;

a freezable pack which can be removably inserted between the pouch and the liquid containment means; and a two-piece stopper having a main body which can be screwed on to the threaded portion of the neck element, said main body bearing an apertured threaded nozzle formation, through which liquid can be ejected in the form of a jet by displacing the rigid walls of the liquid containment means towards each other; and a nozzle cover which can be screwed on to the threaded nozzle formation.

* * * * *